US011072891B2

(12) United States Patent
Ganz

(10) Patent No.: US 11,072,891 B2
(45) Date of Patent: Jul. 27, 2021

(54) TAMPING MACHINE WITH SYNCHRONIZED HYDRAULIC MOTORS

(71) Applicant: MATISA MATERIEL INDUSTRIEL S.A., Crissier (CH)

(72) Inventor: Joerg Ganz, Etoy (CH)

(73) Assignee: MATISA Materiel Industriel S.A., Crissier (CH)

( * ) Notice: Subject to any disclaimer, the term of this patent is extended or adjusted under 35 U.S.C. 154(b) by 374 days.

(21) Appl. No.: 16/071,927

(22) PCT Filed: Jan. 20, 2017

(86) PCT No.: PCT/IB2017/050306
§ 371 (c)(1),
(2) Date: Jul. 23, 2018

(87) PCT Pub. No.: WO2017/125888
PCT Pub. Date: Jul. 27, 2017

(65) Prior Publication Data

US 2019/0032282 A1 Jan. 31, 2019

(30) Foreign Application Priority Data

Jan. 21, 2016 (FR) ..... 16/50464

(51) Int. Cl.
*E01B 27/16* (2006.01)
*E01B 27/20* (2006.01)

(52) U.S. Cl.
CPC ..... *E01B 27/16* (2013.01); *E01B 27/20* (2013.01); *E01B 2203/12* (2013.01)

(58) Field of Classification Search
CPC ..... E01B 27/16; E01B 27/17; E01B 27/20; E01B 2203/12
See application file for complete search history.

(56) References Cited

U.S. PATENT DOCUMENTS 3,669,025 A 6/1972 Plasser et al.
3,981,247 A * 9/1976 Theurer ..... E01B 27/16 104/12
4,068,596 A * 1/1978 Theurer ..... E01B 27/16 104/12
4,094,250 A * 6/1978 Theurer ..... E01B 27/13 104/12
4,130,063 A * 12/1978 Theurer ..... E01B 27/16 104/12
4,942,821 A * 7/1990 Rossanigo ..... B06B 1/12 104/12
5,133,263 A * 7/1992 Theurer ..... E01B 27/16 104/12

(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A tamping machine includes at least one first tamping unit with first tamping tools and a first hydraulic motor provided with a first drive shaft driving the first tamping tools so as to generate tamping movements, and a second tamping unit adjacent the first tamping unit with second tamping tools and a second hydraulic motor provided with a second drive shaft driving the second tamping tools so as to generate tamping movements. The first hydraulic motor and the second hydraulic motor are supplied with power by a common synchronized hydraulic power supply system.

21 Claims, 4 Drawing Sheets

(56) References Cited

U.S. PATENT DOCUMENTS

| | | | | |
|---|---|---|---|---|
| 5,706,734 | A * | 1/1998 | Theuerer | E01B 27/17<br>104/12 |
| 2016/0010287 | A1 | 1/2016 | Lichtberger | |
| 2017/0275828 | A1* | 9/2017 | Seyrlehner | E01B 27/16 |
| 2017/0284033 | A1* | 10/2017 | Lichtberger | E01B 27/16 |
| 2017/0348731 | A1* | 12/2017 | Hoefler | B06B 1/18 |
| 2019/0032282 | A1* | 1/2019 | Ganz | E01B 27/16 |

* cited by examiner

TAMPING MACHINE WITH SYNCHRONIZED HYDRAULIC MOTORS

TECHNICAL FIELD OF THE INVENTION

The invention relates to a tamping machine comprising multiple tamping units.

DESCRIPTION OF THE PRIOR ART

Document EP0564433 describes a tamping machine having four tamping units, each comprising tamping tools arranged one behind the other in the longitudinal direction of the machine for tamping two directly adjacent crossties. The four tamping units can be moved transversely independently of one another. Each tamping unit comprises two tool carriers arranged one behind the other in the longitudinal direction of the machine, and adjustable in terms of height independently of one another. Each tool carrier is intended for one crosstie and has, to that end, a pair of tamping tools and a motor for driving this pair of tools. The resulting tamping machine is universal in the sense that it can be used both on sections of track having a set of switch rails and on sections of track having no set of switch rails. However, the tamping units are very specific and very different from those of a machine intended for in-line tamping of sections of track having no set of switch rails. Furthermore, there is a risk of collision or of jamming of ballast stones between the adjacent tools of the two tool carriers of one and the same pair, in particular when the standard spacing between two adjacent track crossties is reduced.

SUMMARY OF THE INVENTION

The invention aims to remedy the drawbacks of the prior art and to propose a tamping machine comprising tamping units which serve for the in-line tamping of at least two adjacent crossties, reducing the risks of impacts or jamming of ballast stones between adjacent tools.

To that end, what is proposed is a tamping machine comprising at least one first tamping unit comprising first tamping tools and a first motor that is provided with a first drive shaft driving the first tamping tools so as to generate tamping movements, and a second tamping unit adjacent to the first tamping unit and comprising second tamping tools and a second motor that is provided with a second drive shaft driving the second tamping tools so as to generate tamping movements, characterized in that the first motor is a first hydraulic motor, the second motor is a second hydraulic motor and the tamping machine comprises means for the synchronized supply of the first hydraulic motor and of the second hydraulic motor.

The synchronization of the motors serves to avoid the tamping units of the first row colliding with the adjacent tamping units of the second row, given that the longitudinal spacing between the two rows, imposed by the spacing between the adjacent crossties of the section of track, can be relatively small.

The synchronizing means may include a control circuit comprising one or more sensors for determining a rotational speed and a position of the first motor and of the second motor. One of the first and second motors can be a master motor, and the other a slave motor, the control circuit acting on the supply to the slave motor so that this motor is synchronized in terms of speed and position with the master motor.

According to one particularly advantageous embodiment, the tamping machine comprises an electronic control circuit for the synchronized supply means, comprising one or more sensors for determining an instantaneous rotational speed and/or a position of the first drive shaft, and one or more sensors for determining an instantaneous rotational speed and/or a position of the second drive shaft.

According to one embodiment, the electronic control circuit controls the synchronized supply means according to a slaving rule, so that the instantaneous speed of the second drive shaft follows the instantaneous speed of the first drive shaft. According to another embodiment, the electronic control circuit controls the synchronized supply means according to a slaving rule, such that the second drive shaft has an absolute angular offset, relative to the first drive shaft, of less than 10° under nominal operational conditions. The slaving can follow a more complex rule, involving the angular position or the angular offset as well as the rotational speed or the acceleration.

According to one embodiment, the first tamping unit and the second tamping unit are positioned with respect to one another such that the first tamping tools have a trajectory that is within a first geometric envelope, the second tamping tools have a trajectory that is within a second geometric envelope that is located at a nil or positive minimum distance from the first geometric envelope, and the electronic control circuit controls the synchronized supply means according to a slaving rule such that, under nominal use conditions, the second tamping tools are at a distance, strictly greater than the minimum distance, from the first tamping tools.

In practice, the first tamping unit and the second tamping unit are positioned with respect to one another such that, in a synchronized working position, the first tamping unit serves to tamp a first track crosstie and the second tamping unit serves to tamp a second track crosstie that is directly adjacent to the first track crosstie, given a standard spacing between the first track crosstie and the second track crosstie.

The first tamping tools comprise one or more front tamping tools, preferably a front pair of picks, and one or more rear tamping tools, preferably a rear pair of picks, that can be positioned on either side of a first track crosstie, and the second tamping tools comprise one or more front tamping tools, preferably a front pair of picks, and one or more rear tamping tools, preferably a rear pair of picks, that can be positioned on either side of a second track crosstie, preferably immediately adjacent to the first track crosstie. The first tamping unit and the second tamping unit are supported by a common tamping frame that can be moved laterally and/or longitudinally with respect to a frame of the tamping machine. Preferably, the tamping machine comprises an actuator for moving the second tamping unit vertically with respect to a tamping frame of the tamping machine, between a working position and a non-operational position, independently of the first tamping unit.

Preferably, the synchronized supply means comprise a common hydraulic circuit for the synchronized supply of the first hydraulic motor and of the second hydraulic motor. According to one embodiment, the hydraulic circuit for synchronized supply comprises at least one main hydraulic pump for supplying the first hydraulic motor and the second hydraulic motor. The main hydraulic pump may advantageously be connected in series with the first hydraulic motor and the second hydraulic motor, the first hydraulic motor being connected between an output orifice of the main hydraulic pump and the second hydraulic motor. The hydraulic circuit for synchronized supply may further comprise a synchronizing hydraulic pump, and at least one synchronizing valve that is able to move at least between a supply position in which an output orifice of the synchronizing pump is connected between the first hydraulic motor and the second hydraulic motor, and an isolation position in which the synchronizing hydraulic pump is isolated.

According to another embodiment, the synchronized supply means comprise a first hydraulic circuit comprising a first pump for the supply of the first hydraulic motor and a second hydraulic circuit that is independent of the first hydraulic circuit and comprises a second pump for the supply of the second hydraulic motor. The second hydraulic circuit may further comprise a synchronizing hydraulic pump, and at least one synchronizing valve that is able to move at least between a supply position in which an output orifice of the synchronizing pump is connected between the synchronizing hydraulic pump and the second hydraulic motor, and an isolation position in which the synchronizing hydraulic pump is isolated.

BRIEF DESCRIPTION OF THE FIGURES

Other features and advantages of the invention will emerge upon reading the following description, with reference to the appended figures, in which.

For additional clarity, identical or similar elements are identified by identical reference signs in all of the figures.

DETAILED DESCRIPTION OF EMBODIMENTS

Figure 1:
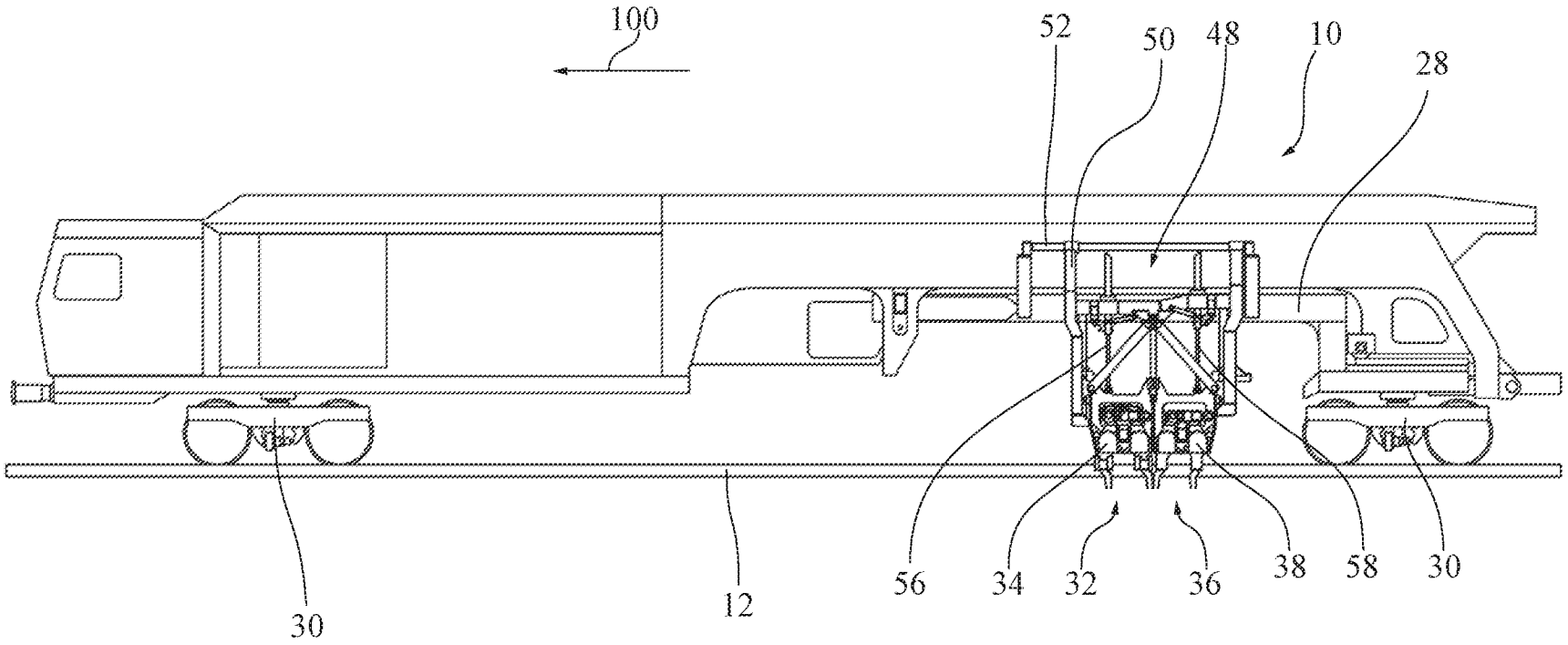
FIG. 1 is a side view of a tamping machine according to one embodiment of the invention.
Figure 2:
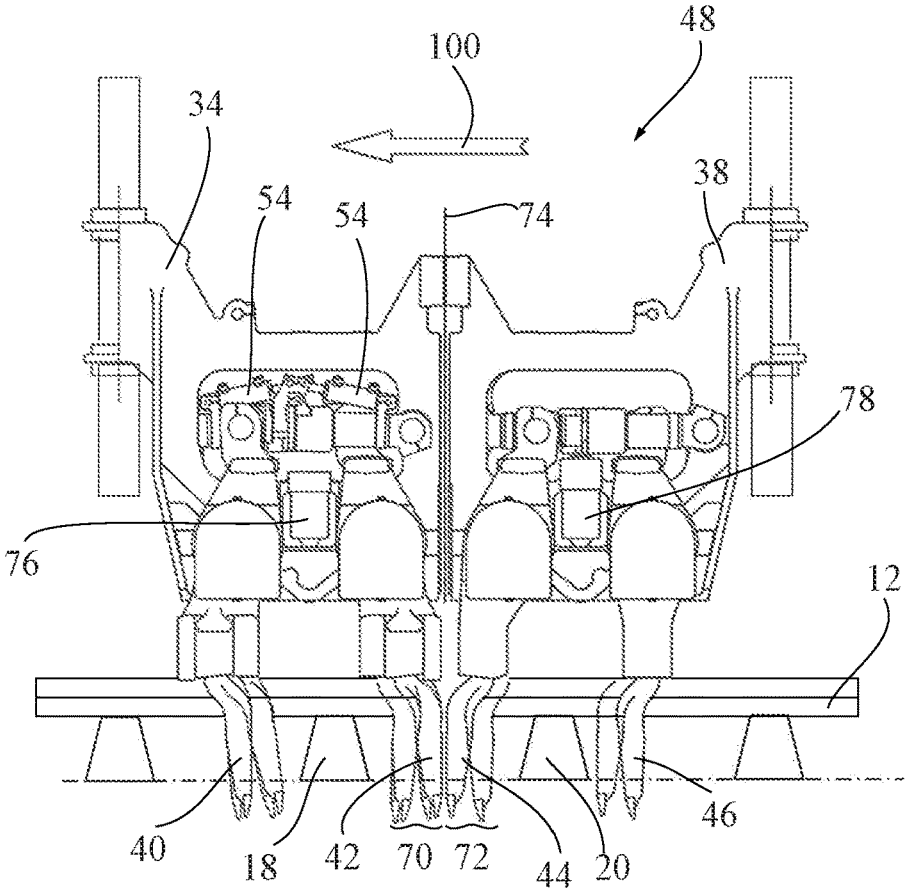
FIG. 2 is a side view of a detail of the tamping machine of FIG. 1, comprising a first row and a second row of tamping units in a working position for the simultaneous tamping of two crossties of a section of railroad track.
Figure 3:
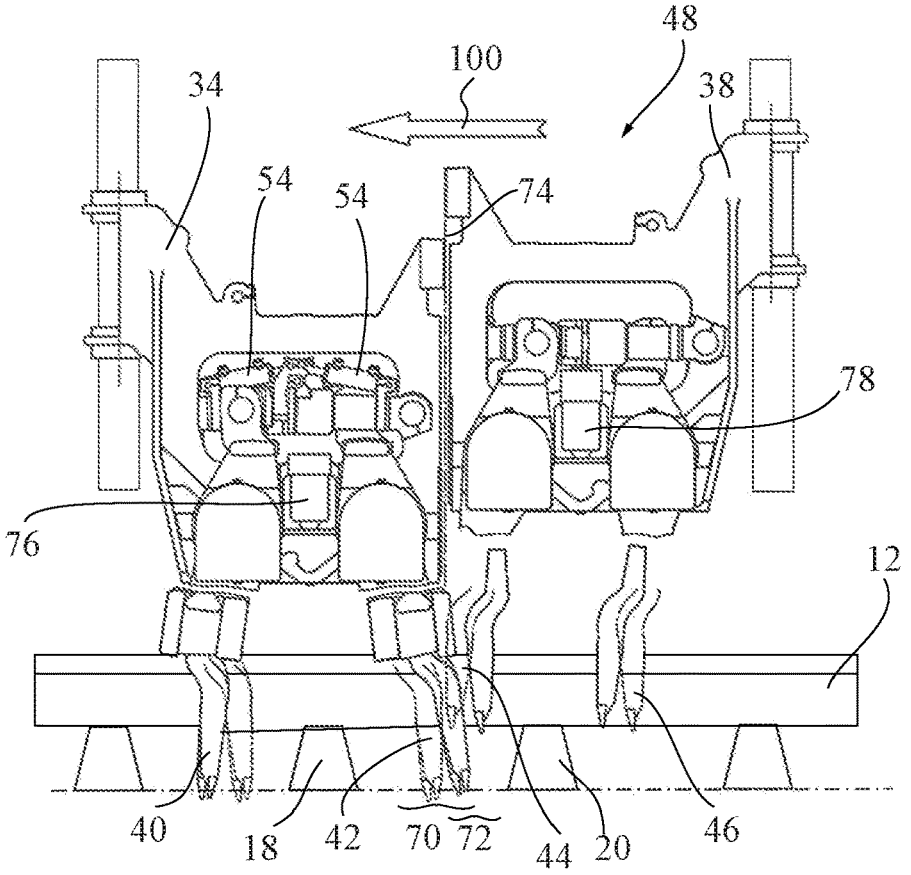
FIG. 3 is a side view of the tamping machine of FIG. 1, in another working position for tamping a crosstie of a switch.
Figure 4:
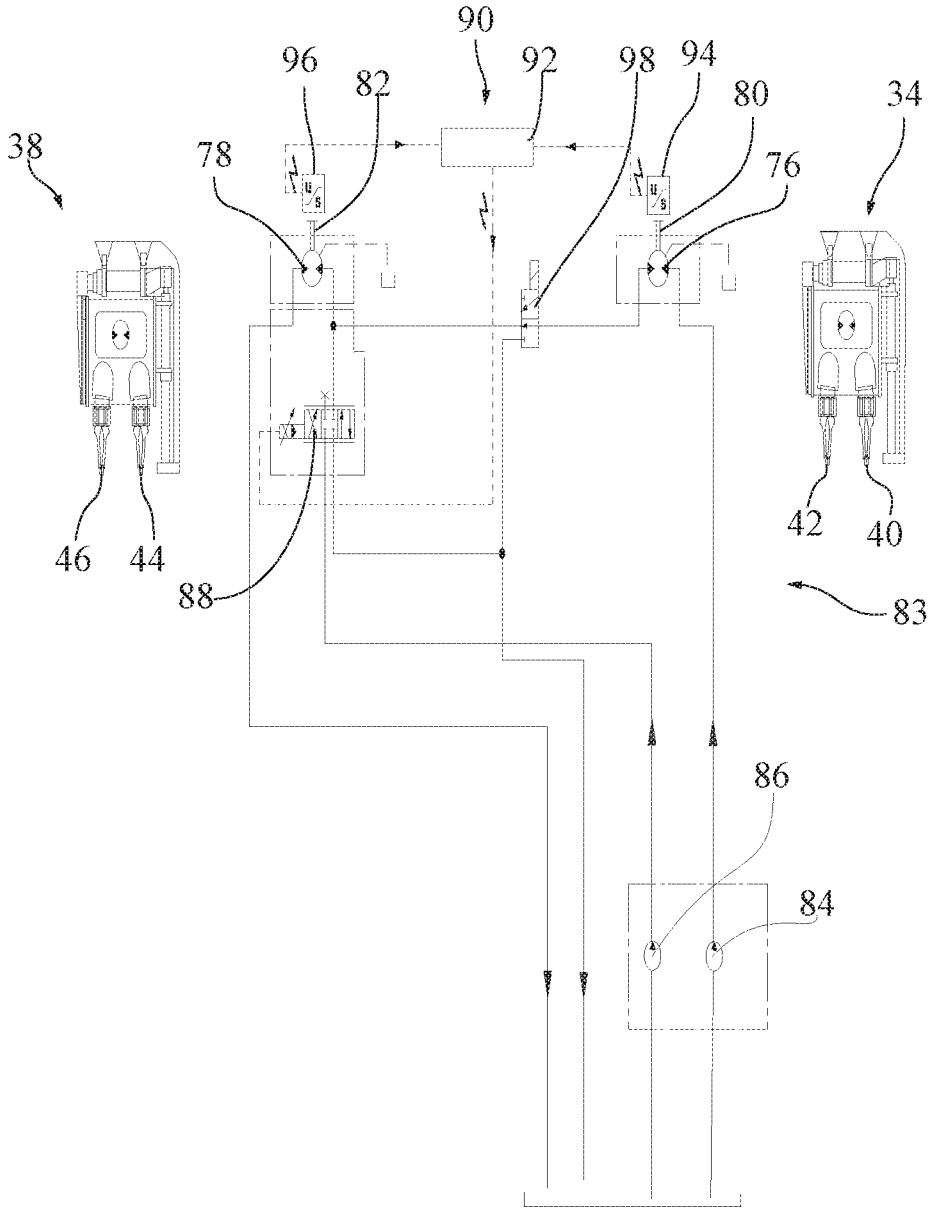
FIG. 4 is a schematic view of an embodiment of a hydraulic circuit for the supply of two adjacent tamping units of the tamping machine according to the invention.

FIGS. 1 to 3 show a tamping machine 10 for the tamping from beneath of a railroad track comprising sections of track 12 consisting of two stretches of rails secured to crossties that rest on ballast, and sections of track comprising a switch, in particular a set of switch rails.

The tamping machine 10 comprises a machine frame 28 that rests on undercarriages 30 having one or more axles, rolling on the track, which frame supports a first row 32 of at least two and preferably at least four tamping units 34, and a second row 36 of at least two and preferably at least four tamping units 38 located, in a direction of travel 100 of the machine, behind the first row 32 and directly adjacent to the first row 32. The distance between the two rows 32, 36 is such that in a working position, illustrated in FIG. 2, the tamping units 34 of the first row 32 serve to tamp the ballast beneath a first crosstie 18 of the railroad track, from in front of and from behind the first crosstie 18, laterally on either side of each of the two stretches of rails, while the tamping units 38 of the second row 36 serve to tamp the ballast beneath a second crosstie 20 of the railroad track, directly adjacent to the first crosstie 18, from in front of and from behind the second crosstie 20, laterally on either side of each of the two stretches of rails. To that end, each tamping unit 34 of the first row 32 comprises front tamping tools 40 and rear tamping tools 42, in this case in the form respectively of a front pair of picks 40 and a rear pair of picks 42 that can be positioned on either side of the first crosstie 18, and, similarly, each tamping unit 38 of the second row 36 comprises front tamping tools 44 and rear tamping tools 46, in this case in the form respectively of a front pair of picks 44 and a rear pair of picks 46 that can be positioned on either side of the second crosstie 20.

Each tamping unit 34 of the first row is associated with a tamping unit 38 which, for its part, is directly adjacent to the second row 36 32, so as to form a subassembly, in this case a pair, of linked adjacent tamping units 48, this pair being supported by a common tamping frame 50 (FIG. 1) that is able to move with respect to the machine frame 28 at least laterally, that is to say in a general direction perpendicular to the rails, and possibly also longitudinally, that is to say in the general direction of the rails. The lateral movement of each tamping frame 50 can be either a movement of translation with respect to the machine frame 28, or, as illustrated in FIG. 1, a pivoting movement about a pivot axis 52 that is fixed with respect to the machine frame 28 and is parallel to a longitudinal direction 100 of the machine frame 28, or also a planar movement composed of one or more rotations about pivot axes that are parallel to the longitudinal direction of the machine frame 28. The same applies to any longitudinal movements of each tamping frame 50 with respect to the machine frame 28 which, in the embodiment of FIG. 1, are brought about by translation along the pivot axis 52, but could be brought about by any other means. These movements are brought about by actuators in a known manner, these actuators not being shown in the figures.

Furthermore, each tamping unit 34 of the first row is provided with additional actuators (FIG. 2) which serve to adjust the positioning of the tamping tools 40, 42 in the longitudinal direction or in the lateral direction with respect to the corresponding tamping frame 50. Where applicable, similar actuators may be provided in order to adjust the positioning of the tamping tools 44, 46 of the tamping units of the second row. This makes it possible to obtain, combining the possibilities of adjusting the tamping frames 50 with respect to the machine frame 28 and the possibilities of individually adjusting the tamping units 34 and possibly 38 with respect to the tamping frames 50, considerable freedom of positioning of the tamping units 34, 38, and large ranges of motion.

Each pair 48 of linked tamping units 34, 38 is provided with an actuator to vertically retract the tamping unit 34 of the first row 32 from the working position to a non-operational position and to deploy it from the non-operational position to the working position. Similarly, each pair of linked tamping units 48 is provided with a retraction actuator to retract the tamping unit 38 of the second row 36 from the working position to a non-operational position and to deploy it from the non-operational position to the working position. The retraction movements of the tamping units of the first row 32 and of the second row 36 can be brought about by upward translation, by upward pivoting, or any type of movement which serves to vertically remove each tamping unit from the track. The system is noteworthy in that the retraction actuators assigned to the second row 36 of tamping units 38 are independent of those of the first row 32, in the sense that it is possible to retract a tamping unit 38 of the second row 36 to the non-operational position while the associated tamping unit 34 of the first row 32 remains in the working position, as shown in FIG. 3.

The proximity of the two rows 32, 36 of tamping units 34, 38 is dictated by the spacing between the track crossties and, in practice, can give rise to risks of collision or jamming of stones between the rear tamping tool or tools 42 of each tamping unit 34 of the first row 32 and the front tamping tool or tools 44 of the directly adjacent tamping unit 38 of the second row 36, in particular if the movements of the tamping tools 42, 44 are not synchronized.

FIG. 2 shows the geometric range of motion envelope 70 of the rear tamping tools 42 of a tamping unit 34 of the first row 32, and the geometric range of motion envelope 72 of the adjacent front tamping tools 44 of a tamping unit 38 of the second row 36. It can be seen in the figure that these envelopes 70, 72 are tangential or even overlap: if the tamping tools 42, 44 were driven without synchronization, they might collide or jam in the presence of a stone from the ballast. Such a situation is avoided by synchronizing the movement of the tamping tools 42, 44 such that, when one is close to the tangential plane 74 between the two envelopes 70, 72, the other is remote therefrom. Ideally, the adjacent tamping tools 42, 44 should be simultaneously in their forwardmost position and simultaneously in their rearmost position, and move in phase.

However, given that each tamping unit 34 of the first row 32 is vertically adjustable independently of the associated tamping unit 38 of the second row 36, it is very complex to envisage driving by a common motor. Thus, each tamping unit 34 and respectively 38 is provided with its own drive motor 76 and respectively 78 which comprises a drive shaft 80 and respectively 82 in order to drive the front and rear tamping tools 40, 42 and respectively 44, 46 in the oscillating tamping movement (cf. FIG. 5). In order to avoid collisions between adjacent tamping tools 42, 44 of the two rows, there are provided means for synchronizing between the motor 76 of each tamping unit 34 of the first row 32 and the motor 78 of the associated tamping unit 38 of the second row 36, while the drive shafts 80, 82 are not mechanically linked.

Figure 5:
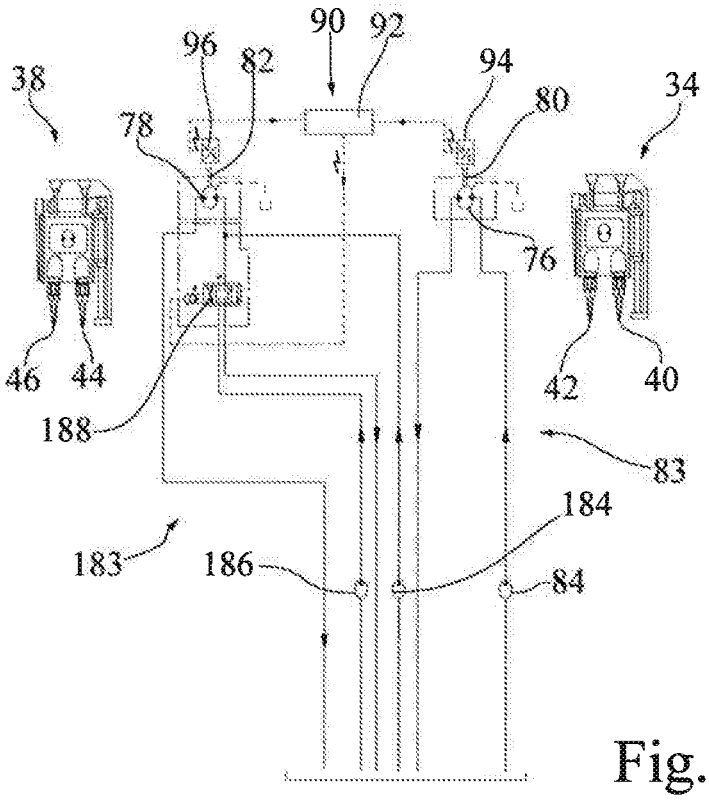
FIG. 5 is a schematic view of another embodiment of hydraulic circuits for the supply of two adjacent tamping units of the tamping machine according to the invention.

FIG. 5 shows a hydraulic circuit 83 connecting, in series, a first hydraulic motor 76 for generating oscillations of the tamping tools 40, 42 of a first tamping unit 34 of the first row 32, a second hydraulic motor 78 for generating oscillations of the tamping tools 44, 46 of the second tamping unit 38 that is adjacent to the first tamping unit 34 and belongs to the same pair 48, and a main hydraulic pump 84 for supplying the first hydraulic motor 76 and the second hydraulic motor 78. Here, the first motor 76 is depicted in series between the main hydraulic pump 84 and the second motor 78, but the converse arrangement is also conceivable.

The two hydraulic motors 76, 78 are volumetric in the sense that their rotational speed is a preferably linear or quasi-linear function of the flow rate. Given that the hydraulic motors 76, 78 are connected in series, a volume of oil coming from the main hydraulic pump 84 and passing through the first motor 76 also passes through the second motor 78, ignoring losses. However, losses due to hydraulic leakages in the hydraulic motor 76 closest to the main hydraulic pump are not negligible and can for example, to give a rough idea, be as high as 5 to 10% of the volume passing through this motor. As a result, in order to maintain synchronization between the two hydraulic motors 76, 78, it is necessary to top up the supply to the hydraulic motor 78 furthest from the main hydraulic pump 84, specifically the second motor in our example. To that end, a synchronizing hydraulic pump 86 is connected, via a synchronizing valve 88, in parallel with the hydraulic motor 78 furthest from the main hydraulic pump 84.

An electronic circuit 90 for controlling the hydraulic supply circuit 83 comprises a microcontroller 92 that is designed to control the synchronizing valve 88 so that the rotation of the hydraulic motor 78 furthest from the main hydraulic pump 84 is slaved to the rotation of the motor 76 closest to the main hydraulic pump 84. Thus, the motor 76 that is supplied solely by the main hydraulic pump 84 can be termed the master motor, and the motor 78 supplied by the main hydraulic pump 84 and the synchronizing hydraulic pump 86 can be termed the slave motor.

One or more rotation sensors 94 connected to the microcontroller 92 serve to determine at least the instantaneous speed and preferably also the angular position of the drive shaft 80 of the master motor 76. Similarly, one or more rotation sensors 96 connected to the microcontroller 92 serve to determine at least the instantaneous speed and preferably also the absolute angular position of the drive shaft 82 of the slave motor 78. The microcontroller 92 compares the values determined in this manner and deduces therefrom if the slave motor 78 is running late and must be accelerated, or is running fast and must be slowed. In the first case, the synchronizing valve 88 is positioned so as to connect an output orifice of the synchronizing pump 86 to the supply orifice of the slave hydraulic motor 78 at the connection between the master motor 76 and the slave hydraulic motor 78. The synchronizing pump 86 then delivers a flow of oil which joins that from the main hydraulic pump 84 and serves to accelerate the rotation of the slave motor 78. In the second case, the synchronizing valve 88 is positioned so as to isolate the synchronizing pump 86, which has the immediate effect of slowing the slave motor 78 owing to the losses in the master motor 76.

Preferably, the master motor 76 is the one which previously has been termed the first motor, specifically the motor driving the tamping unit 34 of the first row 32, the slave motor 78 being that which drives the adjacent tamping unit 38 of the second row 36. It is possible to provide an optional isolation valve 98 between the master motor 76 and the slave motor 78, which valve serves to isolate the slave motor 78 and limit energy consumption while the corresponding tamping unit 38 is non-operational. Alternatively, it is possible, in the absence of such a bypass valve 98, to continuously supply the slave motor 78 even when the corresponding tamping unit 38 is in the retracted, non-operational position.

The mode of operation with slaving of the rotation of the slave motor 78 with respect to the master motor 76 is used at least when the two rows of tamping units 32, 36 are used in parallel, that is to say in sections of track with no switch. Preferably, the synchronizing hydraulic pump 86 is dimensioned so as to be able to more than compensate for the expected losses in the master motor 76, for example with a nominal flow rate strictly greater than a nominal leakage rate of the master motor 76, preferably greater than 1.5 times the nominal leakage rate of the master motor 76, and preferably less than 2 times the nominal leakage rate of the master motor 76. The synchronizing valve 88, for its part, must have a response time that is appropriate for the desired control. By judiciously choosing the response times of the control elements and the control rule, it is possible to minimize the phase shift between the rotation of the shaft 82 of the slave motor 78 and that of the shaft 80 of the master motor 76. In other words, it is possible to slave the rotation of the shaft 82 of the slave motor 78 relative to that of the shaft 80 of the master motor 76 so as to minimize phase shift variations.

In those sections of track having a switch, when the second row 36 of tamping units 38 is in the retracted, non-operational position, the synchronizing hydraulic pump 86 is isolated and can idle or be stopped. If the isolation valve is present, it is also possible to completely isolate the slave motor 78.

The universal tamping machine 10 thus described serves, in sections of track 12 consisting of two stretches of rails secured to crossties resting on ballast, to tamp the ballast beneath a first crosstie 18, from in front of and from behind the first crosstie 18, laterally on either side of each of the two stretches of rails using the first row 32 of at least four tamping units;

and to simultaneously tamp the ballast beneath a second crosstie 20, directly adjacent to the first crosstie 18, from in front of and from behind the second crosstie 20, laterally on either side of each of the two stretches of rails using the second row 36 of at least four tamping units 38.

It also serves, in sections of track that include a switch between the main railroad track and a diverging railroad track, the switch comprising at least one crosstie supporting at least the two stretches of rails of the main railroad track and one diverging stretch of rails of the diverging railroad track, one of the two stretches of rails, referred to as the outer, of the main railroad track being further from the diverging stretch of rails than the other, referred to as the inner, of the two stretches of rails of the main railroad track, to retract the four tamping units 38 of the second row 36 from the working position to a non-operational position, then to adjust the four tamping units 34 of the first row 32 with respect to one another at least in the transverse position and preferably in the longitudinal position, independently of the four tamping units 38 of the second row 36, and to tamp the ballast beneath the crosstie of the switch from in front of and from behind the crosstie of the switch, respectively: laterally on either side of the outer stretch of rails on a side of the inner stretch of track opposite the diverging stretch of track, and on a side of the diverging stretch of track opposite the inner stretch of track.

Naturally, the examples shown in the figures and discussed hereinabove are provided only by way of illustration and are non-limiting.

Where relevant, the master motor 76 may drive the tamping unit 38, the slave motor 76 then driving the tamping unit 34.

As shown in FIG. 5, it is possible to provide two independent hydraulic circuits 83, 183, one to supply the master motor 76 by means of a volumetric pump 84, the other to supply the slave motor 78 by means of a main volumetric pump 184 and a synchronizing hydraulic pump 186 that is connected, via a synchronizing valve 188, in parallel with the main hydraulic pump 184.

An electronic circuit 90 for controlling the hydraulic supply circuit 183 comprises a microcontroller 92 designed to control the synchronizing valve 188 so that the rotation of the slave motor 78 is slaved to the rotation of the master motor 76.

Figure 6:
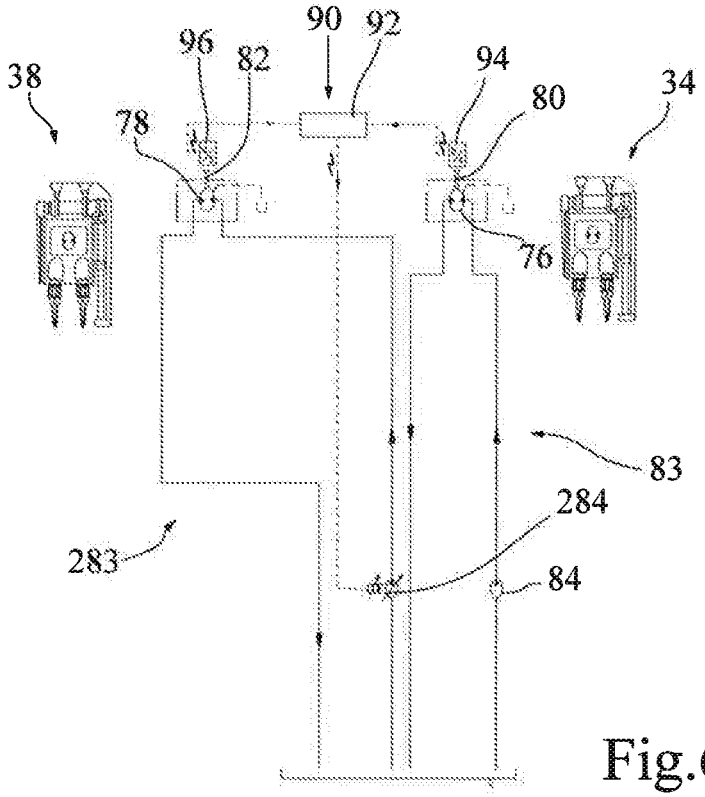
FIG. 6 is a schematic view of another embodiment of hydraulic circuits for the supply of two adjacent tamping units of the tamping machine according to the invention.

According to another variant, shown in FIG. 6, the hydraulic diagram of FIG. 5 is modified using a variable flow rate pump 284 for the circuit 283 for supplying the slave motor 78, the pump 284 being controlled by the electronic control circuit 90.

The tamping machine may further comprise more than two rows of tamping tools. In particular, the tamping unit 38 may, where relevant, be modified to serve for the simultaneous tamping of two or more crossties, such that a pair 48 of linked tamping units 34, 38 secured to a common tamping frame 50 can carry out the in-line tamping of more than two crossties, and retains the possibility, after retraction of the tamping units 38, of tamping the ballast in a section of track having a switch using the tamping units 34 of the first row 32.

It is explicitly provided that the various embodiments described can be combined with one another to form other embodiments.

It is emphasized that all of the features such as will be apparent to a person skilled in the art on the basis of the present description, the drawings and the appended claims, even if not specifically described other than in relation to other certain features, whether individually or in any combination, may be combined with other features or groups of features disclosed here, provided that this has not been expressly excluded or that technical circumstances do not render such combinations impossible or meaningless.

The invention claimed is:

1. A tamping machine, comprising:

at least one first tamping unit having first tamping tools and a first hydraulic motor with a first drive shaft configured for driving said first tamping tools so as to generate tamping movements;

a second tamping unit adjacent said first tamping unit, said second tamping unit having second tamping tools and a second hydraulic motor with a second drive shaft configured for driving said second tamping tools so as to generate tamping movements; and a synchronized supply device for a synchronized supply of said first hydraulic motor and said second hydraulic motor; and an electronic control circuit for said synchronized supply device, said control circuit including one or more sensors for determining an instantaneous rotational speed and/or a position of said first drive shaft, and one or more sensors for determining an instantaneous rotational speed and/or a position of said second drive shaft, said electronic control circuit being configured for controlling said synchronized supply device according to a slaving rule, so that the instantaneous rotational speed of said second drive shaft follows the instantaneous rotational speed of said first drive shaft.

2. The tamping machine according to claim 1, wherein said first tamping unit and said second tamping unit are positioned with respect to one another such that, in a synchronized working position, said first tamping unit serves to tamp a first track crosstie and said second tamping unit serves to tamp a second track crosstie that is directly adjacent the first track crosstie, given a standard spacing between the first track crosstie and the second track crosstie.

3. The tamping machine according to claim 1, wherein said first tamping tools comprise one or more front tamping tools and one or more rear tamping tools to be positioned on either side of a first track crosstie, and said second tamping tools comprise one or more front tamping tools and one or more rear tamping tools to be positioned on either side of a second track crosstie.

4. The tamping machine according to claim 3, wherein:

said front tamping tools of said first tamping tools are a front pair of picks and said rear tamping tools of said first tamping tools are a rear pair of picks;

said front tamping tools of said second tamping tools are a front pair of picks said rear tamping tools of said second tamping tools are a rear pair of picks to be positioned immediately adjacent the first track crosstie.

5. The tamping machine according to claim 1, wherein said first tamping unit and said second tamping unit are supported by a common tamping frame that can be moved laterally and/or longitudinally with respect to a frame of the tamping machine.

6. The tamping machine according to claim 1, further comprising an actuator for moving said second tamping unit vertically with respect to a tamping frame of the tamping machine, between a working position and a non-operational position, independently of said first tamping unit.

7. The tamping machine according to claim 1, wherein said synchronized supply device comprises a common hydraulic circuit for the synchronized supply of said first hydraulic motor and of said second hydraulic motor.

8. The tamping machine according to claim 7, wherein said common hydraulic circuit comprises at least one main hydraulic pump for supplying said first hydraulic motor and said second hydraulic motor.

9. The tamping machine according to claim 8, wherein said main hydraulic pump is connected in series with said first hydraulic motor and said second hydraulic motor, and wherein said first hydraulic motor is connected between an output orifice of said main hydraulic pump and said second hydraulic motor.

10. The tamping machine according to claim 9, wherein said hydraulic circuit further comprises a synchronizing hydraulic pump, and at least one synchronizing valve configured to move at least between a supply position in which an output orifice of said synchronizing pump is connected between said first hydraulic motor and said second hydraulic motor, and an isolation position in which said synchronizing hydraulic pump is isolated.

11. A tamping machine, comprising:

at least one first tamping unit having first tamping tools and a first hydraulic motor with a first drive shaft configured for driving said first tamping tools so as to generate tamping movements;

a second tamping unit adjacent said first tamping unit, said second tamping unit having second tamping tools and a second hydraulic motor with a second drive shaft configured for driving said second tamping tools so as to generate tamping movements; and a synchronized supply device for a synchronized supply of said first hydraulic motor and said second hydraulic motor; and an electronic control circuit for said synchronized supply device, said control circuit including one or more sensors for determining an instantaneous rotational speed and/or a position of said first drive shaft, and one or more sensors for determining an instantaneous rotational speed and/or a position of said second drive shaft, said electronic control circuit being configured for controlling said synchronized supply device according to a slaving rule, for controlling an absolute angular offset of said second drive shaft relative to said first drive shaft to less than 10° under nominal operating conditions.

12. The tamping machine according to claim 11, wherein said first tamping unit and said second tamping unit are positioned with respect to one another such that, in a synchronized working position, said first tamping unit serves to tamp a first track crosstie and said second tamping unit serves to tamp a second track crosstie that is directly adjacent the first track crosstie, given a standard spacing between the first track crosstie and the second track crosstie.

13. The tamping machine according to claim 11, wherein said first tamping tools comprise one or more front tamping tools and one or more rear tamping tools to be positioned on either side of a first track crosstie, and said second tamping tools comprise one or more front tamping tools and one or more rear tamping tools to be positioned on either side of a second track crosstie.

14. The tamping machine according to claim 11, wherein said first tamping unit and said second tamping unit are supported by a common tamping frame that can be moved laterally and/or longitudinally with respect to a frame of the tamping machine.

15. A tamping machine, comprising:

at least one first tamping unit having first tamping tools and a first hydraulic motor with a first drive shaft configured for driving said first tamping tools so as to generate tamping movements;

a second tamping unit adjacent said first tamping unit, said second tamping unit having second tamping tools and a second hydraulic motor with a second drive shaft configured for driving said second tamping tools so as to generate tamping movements; and a synchronized supply device for a synchronized supply of said first hydraulic motor and said second hydraulic motor; and an electronic control circuit for said synchronized supply device, said control circuit including one or more sensors for determining an instantaneous rotational speed and/or a position of said first drive shaft, and one or more sensors for determining an instantaneous rotational speed and/or a position of said second drive shaft;

said first tamping unit and said second tamping unit being positioned with respect to one another such that said first tamping tools have a trajectory that lies within a first geometric envelope;

said second tamping tools have a trajectory that lies within a second geometric envelope that is located even with, or at a positive minimum distance from, said first geometric envelope; and said electronic control circuit being configured for controlling said synchronized supply device according to a slaving rule such that, under nominal use conditions, said second tamping tools are at a distance, strictly greater than the minimum distance, from said first tamping tools.

16. The tamping machine according to claim 15, wherein said first tamping unit and said second tamping unit are positioned with respect to one another such that, in a synchronized working position, said first tamping unit serves to tamp a first track crosstie and said second tamping unit serves to tamp a second track crosstie that is directly adjacent the first track crosstie, given a standard spacing between the first track crosstie and the second track crosstie.

17. The tamping machine according to claim 15, wherein said first tamping tools comprise one or more front tamping tools and one or more rear tamping tools to be positioned on either side of a first track crosstie, and said second tamping tools comprise one or more front tamping tools and one or more rear tamping tools to be positioned on either side of a second track crosstie.

18. The tamping machine according to claim 15, wherein said first tamping unit and said second tamping unit are supported by a common tamping frame that can be moved laterally and/or longitudinally with respect to a frame of the tamping machine.

19. A tamping machine, comprising:

at least one first tamping unit having first tamping tools and a first hydraulic motor with a first drive shaft configured for driving said first tamping tools so as to generate tamping movements;

a second tamping unit adjacent said first tamping unit, said second tamping unit having second tamping tools and a second hydraulic motor with a second drive shaft configured for driving said second tamping tools so as to generate tamping movements; and a synchronized supply device for a synchronized supply of said first hydraulic motor and said second hydraulic motor, said synchronized supply device including a first hydraulic circuit with a first pump for supplying said first hydraulic motor and a second hydraulic circuit independent of the first hydraulic circuit and including a second pump for supplying the second hydraulic motor.

20. The tamping machine according to claim 19, wherein said second hydraulic circuit further comprises a synchronizing hydraulic pump, and at least one synchronizing valve configured to move at least between a supply position in which an output orifice of said synchronizing pump is connected between said synchronizing hydraulic pump and said second hydraulic motor, and an isolation position in which said synchronizing hydraulic pump is isolated.

21. A tamping machine, comprising:

at least one first tamping unit having first tamping tools and a first hydraulic motor with a first drive shaft configured for driving said first tamping tools so as to generate tamping movements;

a second tamping unit adjacent said first tamping unit, said second tamping unit having second tamping tools and a second hydraulic motor with a second drive shaft configured for driving said second tamping tools so as to generate tamping movements; and a synchronized supply device for a synchronized supply of said first hydraulic motor and said second hydraulic motor, said synchronized supply device including a common hydraulic circuit for the synchronized supply of said first hydraulic motor and of said second hydraulic motor, said common hydraulic circuit including at least one main hydraulic pump being connected in series with said first hydraulic motor and said second hydraulic motor for supplying said first hydraulic motor and said second hydraulic motor, and said first hydraulic motor being connected between an output orifice of said main hydraulic pump and said second hydraulic motor; and said hydraulic circuit further including a synchronizing hydraulic pump, and at least one synchronizing valve configured for moving at least between a supply position in which an output orifice of said synchronizing pump is connected between said first hydraulic motor and said second hydraulic motor, and an isolation position in which said synchronizing hydraulic pump is isolated.

* * * * *